US005207776A

United States Patent [19]

Pearce

[11] Patent Number: 5,207,776

[45] Date of Patent: May 4, 1993

[54] BI-METALLIC EXTRUSION BILLET PREFORMS AND METHOD AND APPARATUS FOR PRODUCING SAME

[75] Inventor: Robert J. Pearce, Sewickley, Pa.

[73] Assignee: The Babcock & Wilcox Company, New Orleans, La.

[21] Appl. No.: 771,906

[22] Filed: Oct. 4, 1991

[51] Int. Cl.[5] ..... B22D 19/16

[52] U.S. Cl. ..... 164/98; 164/332

[58] Field of Search ..... 164/91, 94, 95, 98, 164/112, 332, 340, 351, 365

[56] References Cited

U.S. PATENT DOCUMENTS

| | | | |
|---|---|---|---|
| 438,072 | 10/1890 | Everson . | |
| 474,322 | 5/1892 | Harrington . | |
| 798,056 | 8/1905 | Nicholson . | |
| 904,189 | 11/1908 | Everson . | |
| 1,718,627 | 3/1929 | Bleecker . | |
| 2,191,474 | 2/1940 | Hopkins | 22/203 |
| 2,191,475 | 1/1940 | Hopkins | 22/204 |
| 2,191,481 | 6/1940 | Hopkins | 22/203 |
| 2,300,850 | 11/1942 | Wolcott | 29/188 |
| 2,386,747 | 10/1945 | Ris | 138/62 |
| 2,508,465 | 5/1950 | Offinger et al. | 138/62 |
| 2,516,689 | 7/1950 | France et al. | 138/64 |
| 3,310,427 | 3/1967 | Cheney et al. | 164/98 |
| 3,566,741 | 3/1971 | Sliney | 89/36 |
| 3,659,323 | 5/1972 | Hachisu et al. | 164/95 |
| 3,694,271 | 9/1972 | Egnell | 148/12 |
| 3,868,988 | 3/1975 | Hansson et al. | 164/69 |
| 3,885,922 | 5/1975 | Thomas, Jr. et al. | 29/191 |
| 4,016,008 | 4/1977 | Forbes Jones et al. | 138/140 |
| 4,028,785 | 6/1977 | Jackson et al. | 29/157.3 R |
| 4,125,924 | 11/1978 | Goetze et al. | 29/148.4 D |
| 4,367,838 | 1/1983 | Yoshida | 228/112 |
| 4,455,352 | 6/1984 | Ayres et al. | 428/485 |
| 4,478,363 | 10/1984 | Imahashi et al. | 228/131 |
| 4,568,007 | 2/1986 | Fishler | 222/606 |
| 4,685,427 | 8/1987 | Tassen et al. | 122/511 |
| 4,775,000 | 10/1988 | Ayers | 164/464 |
| 4,844,863 | 7/1989 | Miyasaka et al. | 419/8 |

FOREIGN PATENT DOCUMENTS

| | | | |
|---|---|---|---|
| 0018261 | 1/1985 | Japan | 164/95 |

OTHER PUBLICATIONS

Technical Horizons-Composite Tubing and Piping, Ulam, Allegheny Ludlum Steel Corporation, ©1961-8 pages.

Sandvik Steel Catalogue-Composite Tubes For Recovery Boilers, Sandvik Steel, Sweden, 1977-5 pages.

*Primary Examiner*—Richard K. Seidel
*Assistant Examiner*—Eric R. Puknys
*Attorney, Agent, or Firm*—Vytas R. Matas; Robert J. Edwards; Eric Marich

[57] ABSTRACT

A bi-metallic extrusion billet perform is produced in a single casting. An inner core made of a desired material is placed in the center of a crucible or mold as a prepared bar. Molten cladding material is cast into an annular area between the outside surface of the inner core and an inner surface of the crucible or mold. Bottom pouring is enabled through the center of the inner core, which has been appropriately provided with a hole of a size that is consistent with the extrusion press and the required extruded hollow size involved in later manufacturing steps. The entire operation, including the melting of the cladding material, is advantageously performed under a vacuum to eliminate the risk of trapping air at an interface between the inner core and the cladding material cost therearound.

24 Claims, 2 Drawing Sheets

BI-METALLIC EXTRUSION BILLET PREFORMS AND METHOD AND APPARATUS FOR PRODUCING SAME

BACKGROUND OF THE INVENTION

1. Field of the Invention

The present invention relates generally to the manufacture of bi-metallic tubes or pipes and, more particularly, to a bi-metallic extrusion billet preform used in the production of such tubes or pipes, and a method and apparatus for providing such preforms.

2. Description of the Related Art

The operating conditions in many industrial processes require the use of corrosion resistant components. Such corrosion resistant components include tubes or pipes which are directly exposed to the combustion process or to the material involved in the chemical process. Well known examples of such processes include the high corrosion areas of fossil-fueled steam generators firing high chlorine coals, steam generators for waste Kraft liquor, or other types of chemical processing equipment.

A combination of suitable corrosion resistance and mechanical properties is often required, and in many situations conditions on the "water" side and "gas" side of the tubes in the steam generator require different alloy chemistries. A prior art solution to the problem of producing a tubular component suitable for exposure to two different environments, one on the inside of the tube and the other on the outside thereof, is the bi-metallic tube.

One prior art method of producing such bi-metallic tubes is the hot coextrusion process, which is designed to produce a metallurgical bond between inner and outer layers of the tube. Coextruded tubes with stainless steel type 304 and 310 claddings and carbon or low alloy steel substrates have been produced and used widely in the aforementioned applications. The steps of such a typical prior art coextrusion process to produce such a tube comprise:

1. Sleeves of the two alloys are machined to close tolerances and fitted together to form a composite billet.
2. The ends of the sleeve are welded together to prevent ingress of air during preheat and extrusion.
3. The welded billets are preheated and coextruded using standard extrusion practices for stainless tubing, including the use of glass lubricants.
4. When the tube is in its hot finished condition, the glass lubricant is removed and the tube is heat treated to obtain any required mechanical properties.
5. To further reduce the tube diameter, cold rolling or pilgering may be used followed by appropriate heat treatments.
6. The finished tube is extensively tested, especially to verify bond integrity between the layers.

Bi-metallic tubes produced by the aforementioned hot coextrusion process have performed satisfactorily; their major drawback is their relatively high cost. Generally, a low-alloy steel tube with a 2–3 mm cladding of, for example, type 310 stainless steel, costs 7–9 times as much as a low-alloy steel tube, and as much or more than a monolithic tube made of the cladding alloy. Again, certain requirements such as operating conditions and various mandatory boiler codes and the like may prohibit the use of a corrosion resistant monolithic tube made of certain materials in a given environment. Reasons given for such high costs include the cost of billet preparation and the relatively high yield losses due to the large discards at both ends of the finished tube.

Accordingly, since one of the reasons for the high cost of producing a bi-metallic tube by the hot coextrusion process is the cost of producing the initial bullet, it has become desirable to develop a new bi-metallic extrusion billet preform that can be utilized in the prior art hot coextrusion processes but which can be produced at a much lower cost than in the prior art method.

SUMMARY OF THE INVENTION

The present invention is drawn to a method and apparatus for producing a bimetallic extrusion billet preform in a single casting, and the article of manufacture produced thereby.

Accordingly, one aspect of the present invention is drawn to a method for producing a bi-metallic extrusion billet preform. A mold is provided for the preform. A metal core having a bore which extends along an entire length of the core is placed into the mold, leaving an annular area between an outside surface of the core and an inner surface of the mold. Molten cladding metal is delivered into the bottom of the mold through the bore to fill the annular area with the molten cladding metal. The molten cladding metal is then allowed to solidify around the core and produce the extrusion billet preform.

Another aspect of the present invention is drawn to an apparatus for producing a bi-metallic extrusion billet preform. The apparatus comprises a metal core having a bore which extends along an entire length of the core and a mold having an open top portion for receiving the core. The mold is sized so that when the core is placed into the mold, an annular area will exist along the entire length of the core between an outside surface of the core and an inner surface of the mold. Means are provided for delivering a molten cladding metal through the bore to a location at a bottom portion of the mold. Finally, means for distributing the molten cladding metal are provided which distribute it from the location at the bottom portion of the mold to the annular area and produce the extrusion billet preform.

Another aspect of the present invention is drawn to an article of manufacture, namely a bi-metallic extrusion billet preform. The preform comprises an inner metal core having a bore which extends along an entire length of the core and an outer layer of clad metal, bottom poured and cast around the inner metal core while in a molten state. The outer layer of clad metal is metallurgically bonded at a clad/core interface during solidification of the clad metal layer around the inner metal core.

The various features of novelty which characterize the invention are pointed out with particularity in the claims annexed to and forming a part of this disclosure. For a better understanding of the present invention and the advantages attained by its use, reference is made to the accompanying drawings and descriptive matter in which a preferred embodiment of the invention is disclosed.

DESCRIPTION OF THE PREFERRED EMBODIMENT

Figure 1:
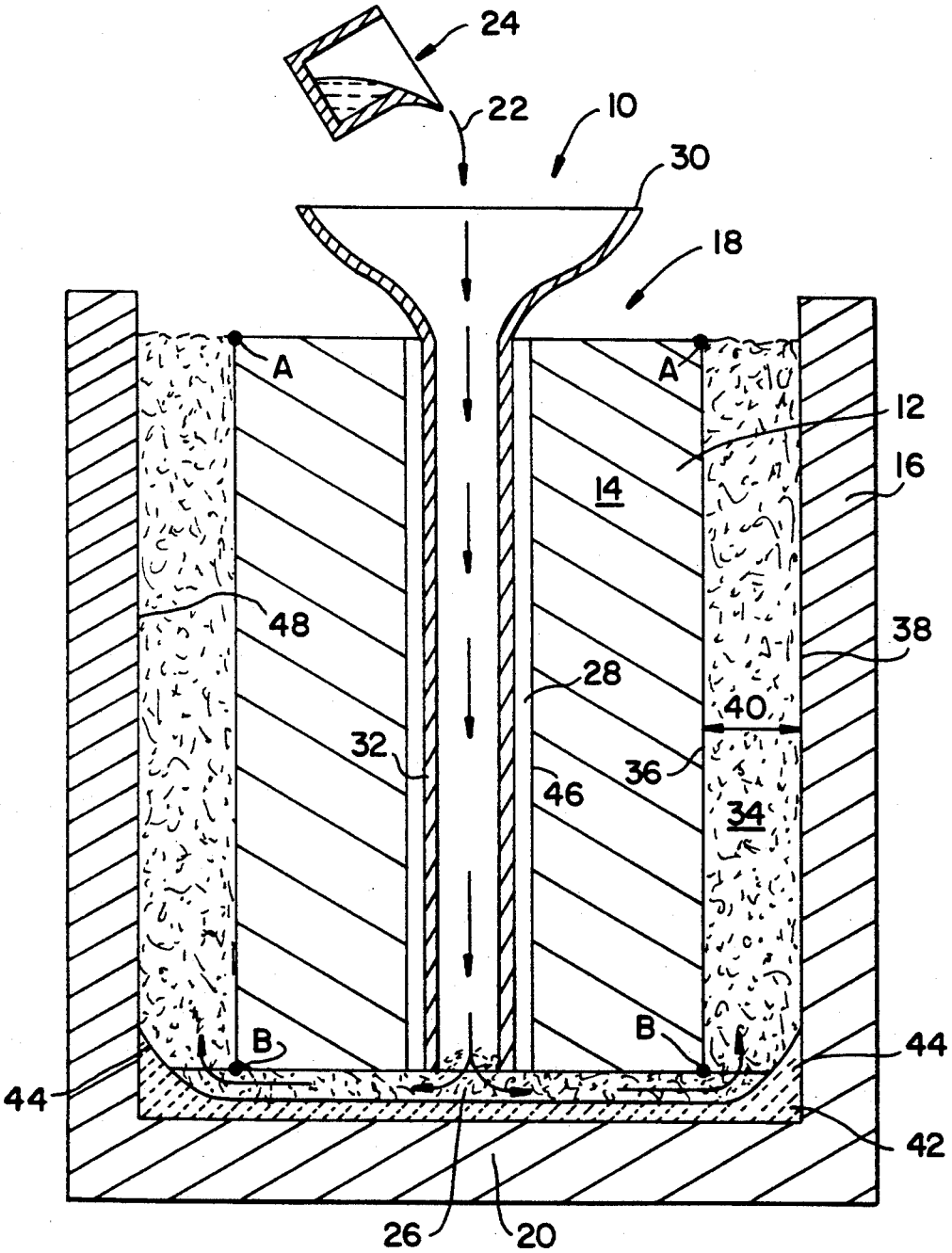
FIG. 1 is a schematic and sectional view, (not to scale), of an apparatus used in and embodying several aspects of the present invention.

The Figures provided with this disclosure are set forth to illustrate various features of the invention without limiting the scope of the invention thereto. Like numerals designate the same element throughout the several drawings. Referring to FIG. 1 in particular, there is shown an apparatus generally referred to as (10) for producing a bi-metallic extrusion billet preform (12) in a single casting. As used herein, the term bi-metallic extrusion billet preform refers to preforms used to create tubes or pipe in which there is a stainless steel coating, such as Type 304 or 310 stainless steel, over a carbon steel or low alloy steel inner layer. As shown in FIG. 1, an inner metal core (14), advantageously made of a desired material such as carbon steel or low alloy steel, is placed substantially in the center of a crucible or mold (16). The crucible or mold (16) has an open top portion (18) and a closed bottom portion (20). Molten cladding metal (22), advantageously Type 304 or 310 stainless steel, is provided by a melting furnace schematically shown at (24). The molten cladding material (22) is bottom poured to a location (26) at the bottom portion (20) of the mold (16) via a bore (28) in the inner metal core (14). As is known in the steel industry, and at least for the last ten years or so, bottom pouring has been determined to be the preferred method of pouring any type of a molten metal into a crucible or mold. The reason for this type of pouring procedure is that when one pours from the top of a mold, the fall of the molten metal along the vertical height of the mold and its contact with the bottom causes the liquid metal to splash and produce globules of the frozen metal. These globules form a grain boundary at their interface with the rest of the poured molten metal and even if some remelting occurs, "scabs" form on the surface which are detrimental to subsequent operations. This detrimental effect is manifested by tearing of the metal surface during subsequent working operations. Another advantage achieved by pouring from the bottom is that the molten metal is agitated during the solidification process.

To facilitate the bottom pouring operation, means are provided for delivering the molten cladding metal (22) through the bore (28) to the location (26). In a preferred embodiment, this means comprises a refractory funnel (30) for receiving the molten cladding metal (22) and a bottom pouring tube (32) connected to the funnel (30) for directing the molten cladding metal (22) through the bore (28) to the location (26).

Once the molten cladding metal (22) is provided to the bottom portion (20) of the mold (16), it must be distributed to an annular area (34) which extends for an entire length of the core (14) between an outside surface (36) of the core (14) and an inner surface (38) of the mold (16). The annular area (34) is also partially defined by a width (40) defined as the distance between the outside surface (36) of the inner core (14) and the inner surface (38) of the mold (16).

In a preferred embodiment, the means for distributing the molten cladding metal (22) comprises a bottom pouring distribution manifold (42) placed on the bottom portion (20) of the mold (16). The bottom pouring distribution manifold (42) supports the inner core (14), as well as the molten cladding metal (22) during and after distribution to the annular area (34). Advantageously, the bottom pouring distribution manifold (42) is made of granulated refractory compressed into a desired shape to direct the molten cladding metal (22) from the location (26) outwardly towards the annular area (34). If necessary, the bottom pouring distribution manifold (42) is shaped so as to provide a tapered front end (44) on the extrusion billet preform (12) to facilitate processing in subsequent extrusion processes. It should be noted at this point that FIG. 1 shows the apparatus (10) as it would be used, oriented in the vertical direction. Thus, the vertical height of the mold (16) would lie in a direction between the open top portion (18) and the lower bottom portion (20). However, the front end portion of the extrusion billet preform (12) is located at the bottom portion of the mold (16), while the rear end portion of the preform (12) is located at the open top portion of the mold (16). The front end portion of the preform (12) is defined as that portion which would be first to enter an extrusion mill (not shown) for subsequent extrusion operations; the rear end portion of the preform (12) will be pushed by a ram (not shown) of the extrusion mill. (34) surrounding the inner metal core (14), the extrusion billet preform (12) must be removed from the mold (16). In some situations, it may be advantageous to provide the mold (16) with an open top portion (18) that is slightly larger than the bottom portion (20) of the mold (16), thereby producing a tapering inner surface (38) that would facilitate removal of the extrusion billet preform (12) from the mold (16). Generally, the bore (28) is defined by an inside surface (46) which is machined to a desired surface finish. Similarly, the outside surface (36) of the inner core (14) will also be machined to a desired surface finish. Both machining operations would occur prior to placement of the inner metal core (14) in the mold (16). If a mold (16) having a tapering inner surface (38) is utilized, it may be desirable to machine the outside surface (36) of the inner core (14) so that it matches the degree of taper of the mold inner surface (38). In this way, the annular area (34) will have a width (40) that is substantially constant along a vertical height of the preform (12). In a preferred embodiment, since the extrusion billet preform will be used to produce axially symmetric components such as tubes or pipes, the bore (28) will be located substantially at the center of the inner core (14). The diameter of the bore (28) will generally be chosen to be consistent with that required by any subsequent extrusion processes that would further process the extrusion billet preform (18) into a desired extruded hollow size. Typically, the diameter of the bore (28) in the inner metal core (14) is in the range of approximately 2½-3 inches, just large enough to accommodate the aforementioned refractory funnel (30) and attached bottom pouring tube (32).

Typical dimensions of the mold (16) and extrusion billet preform (12) are as follows. The mold (16) would typically have an inside diameter (measured in between the inner surface (38) thereof) in the range of approximately 6 inches to 12 inches. The annular area (34) would typically have a width in the range of approximately ½ inch to 1 inch. The inner metal core (14), and of course the resulting extrusion billet preform (12), would generally have a length/height in the range of approximately two (2) to four (4) feet.

As is well known to those skilled in the art, the particular size of the extrusion billet preform is determined by the type of extrusion press used in subsequent operations. Extrusion presses are generally rated in tons of capacity by which they can force the extrusion billet preform through a die. For example, one could have a 3,000 ton or a 6,000 ton extrusion mill. For the particular 12 inch size extrusion billet preform shown and described, a 5,000–7,000 ton press might be utilized. During the extrusion process itself, the extrusion billet is typically extruded to a length of between 10× to 20× the initial billet length. At the same time, the thickness of the wall (as well as the cladding metal (22) cast around the inner metal core (14) in the annular area (34)) is reduced due to the lengthening inherent to the extrusion process.

As previously indicated, the inner surface (38) of the crucible or mold (16) will generally be vertical, but there may be an outward taper provided towards the open top portion (18) to facilitate removal of the extrusion billet preform (12) after solidification. In general, the taller the crucible or mold (16), the more taper that would be required. However, the solidification of the molten cladding material (22) around the inner metal core (14) causes the extrusion billet preform (12) to shrink somewhat which also facilitates removal.

Once the extrusion billet preform (12) has solidified, it will generally be machined so that it has a flat end at the rear end portion or "hot top" end, and the outside diameter (48) of the preform (12) will be machined to a desired surface finish. The front end portion (44) will be either cast or prepared to have a slight radius at its perimeter. These operations facilitate processing in the extrusion mill or press.

Digressing for a moment, one prior art method of making bi-metallic extrusion billet preforms required the machining of an inner core and of an outer cladding or tube layer within which the inner core would be inserted. A weld would be applied at either end of these pieces to prevent air from entering during the subsequent extrusion processes. These pieces would be welded in a vacuum to prevent oxygen from being trapped at the interface between the inner core and the outer cladding layer. The extrusion process itself would then create a metallurgical bond between the inner core and the outer cladding layer. At a later point in time, the welds emplaced at the ends of the preforms to prevent air from entering would no longer be needed. Purchasers of bi-metallic tubes have become accustomed to expecting this type of vacuum processing method so that no air becomes trapped at the interface, alleviating potential concerns with respect to corrosion.

As shown in FIG. 1, the inner metal core (14) may be provided with a first weld bead A around the core (14) at a rear end portion thereof, and a second weld bead B around the core (14) at a front end portion thereof. These weld beads A and B are located at a peripheral interface between the inner metal core (14) and the outer layer of cladding metal (22) cast in the annular area (34) to assure bonding of the cladding metal (22) to the inner metal core (14). As indicated earlier, it may be desirable to preform all of the manufacturing steps for making the extrusion billet preform under a vacuum or inert atmosphere to minimize the chance of air becoming trapped at the interface between the inner metal core (14) and the outer layer of cladding metal (22). The welds A and B are thus provided so that when the molten cladding metal (22) is cast around the inner metal core (14), a seal could be maintained as in the prior art once the extrusion billet preform has solidified, cooled and been removed from the mold (16).

Figure 2:
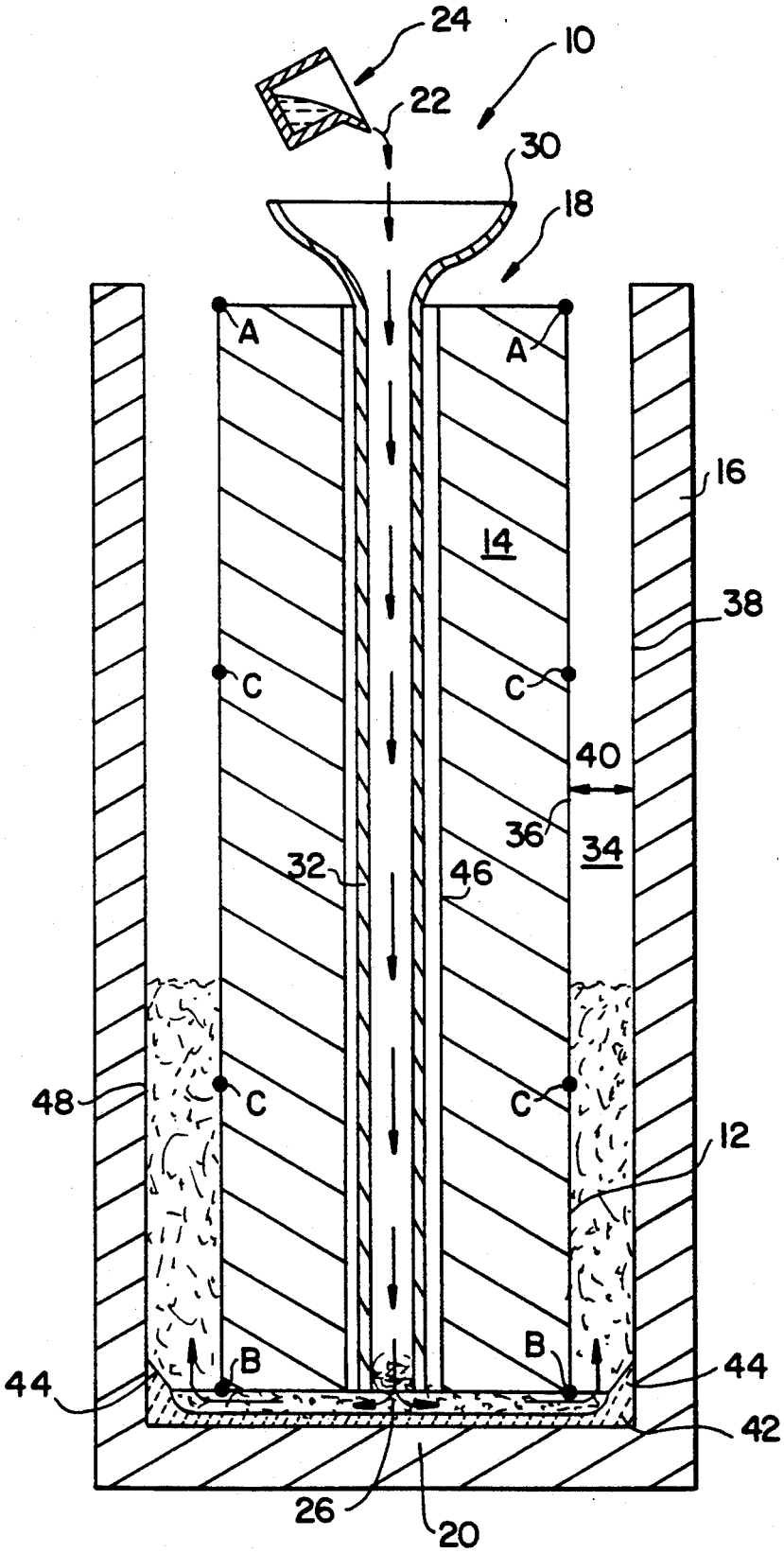
FIG. 2 is a schematic and sectional view, (also not to scale), of another embodiment of the present invention.

As indicated earlier, the extrusion billet preforms are generally of a length/height in the range of approximately two (2) to four (4) feet. However, it is possible for the extrusion billet preforms to be made much taller than this length; for example, an extrusion billet preform could be made in lengths that are multiples of the desired (final) extrusion billet length as well, the preform would then be later cut into finished billet pieces of the desired length. This particular variation is shown in FIG. 2. Like numerals again designate the same elements. As shown therein, a series of intermediate welds C would be provided along the length of the inner metal core (14), prior to placement within the mold (16). As shown in FIG. 2, the pouring of the molten cladding metal (22) has proceeded to approximately the halfway point in the process of casting the extrusion billet preform (12). When pouring has been completed, the annular area (34) will be filled with the molten cladding metal (22) along the entire vertical length/height of the inner metal core (14). The location of the additional intermediate beads C are at positions which mark the required final extrusion billet lengths. As shown, the as manufactured extrusion billet preform (12) could thus have an overall length as long as three (3) times the final billet length, but prior to its extrusion in the extrusion press, it would be cut at each of the intermediate welds C to produce three smaller extrusion billet preforms of approximately the required length each, each still sealed by the welds A or B and C.

In most extrusion applications, the diameter of the required extrusion billet preform is in the aforementioned range of 6 inches to 12 inches. As such, the distance between the outside surface (36) of the inner metal core (14) and the inner wall (38) of the mold (16) is relatively small, again within the range of ½ inch to 1 inch. As solidification proceeds from both sides of the annular area (34) into the center, a fine grain structure will form at the interface between the inner mold surface (38) (due to rapid cooling), while at the same time there will be very limited opportunity for segregation or dendritic/columnar grain growth in the interior portion of the annular area (34) near the outside surface (36) of the inner metal core (14). Given the difficult hot working characteristics of some materials (for example, austenitic stainless steels) a fine grain structure at the exterior is important for good surface quality of the extruded hollow. However, it is possible that further treatment of the exterior surface of the extrusion billet preform (12) would be required to assure a suitable grain configuration, one that is consistent with acceptable quality in the extruded hollow. Accordingly, the present invention contemplates the use of shot peening on the outside surface (48) of the extrusion billet preform (12) as a means toward this end.

Vacuum (or inert gas atmosphere) processing eliminates the risk of trapping air at the interface between the cladding and the inner metal core, while it also benefits the steel cleanliness by minimizing the opportunity for oxidation, and the formation of non-metallic inclusions and scale. Additionally, the removal of oxygen and hydrogen improves the cast structure by minimizing the occurrence of piping, blow holes and other undesirable characteristics.

It is desired that a metallurgical bond be formed at the interface between the inner metal core (14) and the outer layer of clad metal (22). However, particular types of metal combinations may involve the use of a cladding metal (22) whose melting point is lower than that of the inner metal core (14) material. If the difference in melting point is small enough, then the hot molten cladding metal (22) may be poured with a sufficient superheat so as to assure melting at the interface of it with outside surface (36) of the inner metal core (14). When the possibility does not exist, then other means must be used for securing the interface. The previously described approach of placing weld beads A, B and C around the periphery of the inner metal core (14), would assure bonding of the clad material at these points. In the alternative situation where the cladding metal (22) has a higher pouring temperature than the melting point of the inner metal core (14), then localizing melting of the inner metal core (14) will cause only limited dilution at the interface therebetween.

While in accordance with provisions of the statutes a specific embodiment of the present invention has been shown and described herein in detail to illustrate the application and principles of the invention, it is not intended that the present invention be limited thereto. Certain modifications and/or improvements will occur to those skilled in the art upon reading the foregoing description and it will thus be appreciated that certain features of the invention may sometimes be used without a corresponding use of the other features; as such, the invention may be embodied otherwise without departing from such principles. It is thus understood that all such modifications and/or improvements have been deleted herein for the sake of conciseness and readability but are properly with the spirit and scope of the following claims.

What is claimed as new and desired to be secured by Letters Patent of the United States is:

1. A method for producing a bi-metallic extrusion billet preform in a single casting, comprising the steps of:

providing a mold for said preform;

providing a bottom pouring distribution manifold on a bottom surface of said mold;

providing a metal core having a bore which extends along an entire length of said core;

placing said core into said mold so that said manifold supports said core, leaving an annular area between an outside surface of said core and an inner surface of said mold;

delivering a molten cladding metal into a bottom of said mold via a bottom pouring tube positioned within said bore so that the molten cladding metal is delivered directly to said manifold in a bottom pouring operation, filling said annular area with said molten cladding metal; and allowing said molten cladding metal to solidify around said core to produce said extrusion billet preform.

2. The method of claim 1, further comprising the step of shaping said bottom pouring distribution manifold at a bottom portion of said inner surface of said mold to provide a tapered end on said extrusion billet preform.

3. The method of claim 1, further comprising the steps of machining an inside surface defining said bore and machining said outside surface of said core to achieve a desired surface finish, prior to placing said core into said mold.

4. The method of claim 3, further comprising the step of machining said outside surface of said core to match a tapering shape of said mold inner surface so that said annular area has a width that is substantially constant along a vertical height of said preform.

5. The method of claim 1, further comprising the steps of providing a first weld bead A at a rear end portion of said core and a second weld bead B at a front end portion of said core prior to placing said core into said mold, and locating said weld beads at an interface between said core and said cladding metal.

6. The method of claim 1, further comprising the step of removing said extrusion billet preform from said mold.

7. The method of claim 6, further comprising the step of treating an exterior surface of said extrusion billet assuring a suitable grain configuration that is consistent with an acceptable quality after said billet is subjected to a hot coextrusion process.

8. The method of claim 7, wherein said treating step comprises shot peening of said exterior surface of said billet.

9. The method of claim 6, further comprising the steps of providing a first weld bead A at a rear end portion of said core and a second weld bead B at a front end portion of said core, and locating said weld beads at a peripheral interface between said core and said cladding metal thereby assuring bonding of said cladding metal to said core.

10. The method of claim 1, wherein said steps are all performed under vacuum (or inert gas atmosphere) to eliminate a risk of trapping air at an interface between said core and said molten cladding metal.

11. An apparatus for producing a bi-metallic extrusion billet preform in a single casting, comprising:

a metal core having a bore which extends along an entire length of said core;

a mold having an open top portion for receiving said core, sized to provide an annular area for said entire length of said core between an outside surface of said core and an inner surface of said mold;

means for delivering a molten cladding metal through said bore to a location at a bottom portion of said mold; and a bottom pouring distribution manifold placed on said bottom portion of said mold for supporting said core in said mold and made of granulated refractory material compressed into a desired shape to direct a flow of said molten cladding metal from said location to said annular area to fill same and produce said extrusion billet preform.

12. The apparatus of claim 11, wherein said core has an inside surface defining said bore and wherein said inside and outside surfaces of said core are machined to a desired surface finish.

13. The apparatus of claim 11, wherein said open top portion of said mold is slightly larger than said bottom portion of said mold to produce a tapering inner surface of said mold which facilitates removal of said from said mold.

14. The apparatus of claim 11, wherein said means for delivering a molten cladding metal through said bore to a location at a bottom portion of said mold comprises a refractory funnel for receiving said molten cladding metal and a bottom pouring tube connected to said funnel for delivering said molten cladding metal through said bore to said location.

15. The apparatus of claim 12, wherein said outside surface of said core is machined to match a tapering surface of said mold inner surface so that said annular area has a width that is substantially constant along a vertical height of said preform.

16. The apparatus of claim 11, wherein said bore is located substantially at the center of said core.

17. The apparatus of claim 16, wherein said bore has a diameter consistent with that required by a subsequent extrusion process that will further process said preform into a desired extruded hollow size.

18. The apparatus of claim 11, wherein said bottom pouring distribution manifold is shaped to provide a tapered front end on said extrusion billet preform to facilitate processing in a subsequent extrusion process.

19. The apparatus of claim 11, wherein said mold has a diameter in the range of approximately 6"–12".

20. The apparatus of claim 11, wherein said annular area has a width in the range of approximately ½"–1".

21. The apparatus of claim 11, wherein said metal core has a length/height in the range of approximately two (2) to four (4) feet.

22. The apparatus of claim 11, wherein said core has a first weld bead A around said core at a rear end portion thereof and a second weld bead B around said core at a front end portion thereof, said weld beads located at a peripheral interface between said core and said cladding metal to assure bonding of said cladding metal to said core.

23. The apparatus of claim 22, wherein said core and mold has an overall length/height that is a multiple of a required extrusion billet preform length and wherein said core co-extends along said preform for said overall length/height.

24. The apparatus of claim 23, wherein said core, preform and mold have an overall length/height that is a multiple of a required extrusion billet preform length, and wherein said core has additional weld beads located at intermediate positions marking the required extrusion billet preform lengths.

* * * * *